US009205937B2

(12) United States Patent
Krulitsch et al.

(10) Patent No.: US 9,205,937 B2
(45) Date of Patent: Dec. 8, 2015

(54) FILLING ELEMENT, METHOD AND FILLING SYSTEM FOR FILLING CONTAINERS

(75) Inventors: Dieter-Rudolf Krulitsch, Bad Kreuznach (DE); Jonathan Lorenz, Bad Kreuznach (DE); Manfred Hartel, Bretzenheim (DE); Andreas Fahldieck, Idar-Oberstein (DE); Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 288 days.

(21) Appl. No.: 13/809,298

(22) PCT Filed: May 12, 2011

(86) PCT No.: PCT/EP2011/002364

§ 371 (c)(1),
(2), (4) Date: Jan. 9, 2013

(87) PCT Pub. No.: WO2012/007075

PCT Pub. Date: Jan. 19, 2012

(65) Prior Publication Data

US 2013/0105041 A1 May 2, 2013

(30) Foreign Application Priority Data

Jul. 16, 2010 (DE) ..... 10 2010 027 512 U

(51) Int. Cl.
*B65B 3/04* (2006.01)
*B67C 3/26* (2006.01)

(52) U.S. Cl.
CPC ... *B65B 3/04* (2013.01); *B67C 3/26* (2013.01); *B67C 3/2622* (2013.01)

(58) Field of Classification Search
CPC ..... B65B 3/04; B67C 3/26; B67C 3/2622
USPC ..... 141/5, 44, 89–91, 144–145, 392
See application file for complete search history.

(56) References Cited

U.S. PATENT DOCUMENTS

| | | | | |
|---|---|---|---|---|
| 2,168,380 | A | 8/1939 | Winton | |
| 2,796,892 | A * | 6/1957 | Meyer | 141/48 |
| 3,128,915 | A | 4/1964 | Matter | |
| 4,442,873 | A * | 4/1984 | Yun | 141/39 |
| 5,402,833 | A * | 4/1995 | Clusserath | 141/39 |
| 5,865,225 | A | 2/1999 | Weiss | |
| 6,463,964 | B2 * | 10/2002 | Clusserath | 141/40 |
| 6,474,368 | B2 * | 11/2002 | Clusserath et al. | 141/6 |
| 7,299,833 | B2 * | 11/2007 | Ruble et al. | 141/146 |

(Continued)

FOREIGN PATENT DOCUMENTS

| | | |
|---|---|---|
| EP | 0694021 B1 | 7/1998 |
| EP | 1623952 | 2/2006 |

(Continued)

*Primary Examiner* — Nicolas A Arnett
(74) *Attorney, Agent, or Firm* — Occhiuti & Rohlicek LLP

(57) ABSTRACT

Filling element for filling containers with a liquid charge, having at least one liquid channel, which is formed in a filling element housing and in which, in the direction of flow of the charge, at least one liquid valve actuated by an actuating mechanism is provided upstream of a dispensing opening, specifically for dispensing the liquid charge in a controlled manner through the dispensing opening into the respective container. The liquid channel is designed with a venting system.

20 Claims, 3 Drawing Sheets

(56) References Cited

U.S. PATENT DOCUMENTS

| | | | | |
|---|---|---|---|---|
| 7,350,545 | B2 * | 4/2008 | Ruble et al. | 141/147 |
| 7,469,726 | B2 * | 12/2008 | Clusserath et al. | 141/57 |
| 7,958,917 | B2 * | 6/2011 | Conforti | 141/95 |
| 8,459,315 | B2 * | 6/2013 | Clusserath et al. | 141/90 |
| 8,776,842 | B2 * | 7/2014 | Clusserath | 141/91 |
| 2001/0045242 | A1 * | 11/2001 | Clusserath et al. | 141/144 |
| 2002/0014276 | A1 * | 2/2002 | Clusserath | 141/40 |
| 2005/0241726 | A1 * | 11/2005 | Clusserath et al. | 141/144 |
| 2006/0137762 | A1 * | 6/2006 | Ruble et al. | 141/144 |
| 2010/0071802 | A1 * | 3/2010 | Clusserath et al. | 141/44 |
| 2010/0108180 | A1 * | 5/2010 | Clusserath | |
| 2011/0108155 | A1 * | 5/2011 | Meinzinger | 141/1 |

FOREIGN PATENT DOCUMENTS

| | | |
|---|---|---|
| EP | 2314538 | 4/2011 |
| WO | 1994024037 | 10/1994 |
| WO | 2010017888 | 2/2010 |

* cited by examiner

FILLING ELEMENT, METHOD AND FILLING SYSTEM FOR FILLING CONTAINERS

RELATED APPLICATIONS

This application is the national phase under 35 USC 371 of international application no. PCT/EP2011/002364, filed May 12, 2011, which claims the benefit of the priority date of German application no. 10 2010 027 512.3, filed Jul. 16, 2010. The contents of the aforementioned applications are incorporated by reference herein in their entirety.

FIELD OF DISCLOSURE

The invention relates to a filling element for filling containers with a liquid charge, to a method for venting filling elements of a filling apparatus, and to a filling system.

BACKGROUND

A problem that arises in known filling systems is that sometimes, under certain conditions, in particular including under operating conditions, gas and/or vapor that does not belong to the charge enters the interior of the filling element or the liquid channel thereof. Examples of foreign gases that may inadvertently enter include, for example, air and/or residues of a cleaning and/or disinfecting medium in gas and/or vapor form that was used to clean and/or disinfect the filling system or filling machine.

There are certain times when the filling machine is particularly vulnerable to entry of gaseous contaminants. These include after cleaning the filling machine and before filling starts again, for example after a change of product. Filling machines are also vulnerable to entry of gaseous contaminants during unfavorable flow conditions at the mouth or dispensing opening of the filling element. These conditions can exist at the start of the filling process for a particular container. Sometimes, gaseous contaminants enter during start-up of a filling machine, or after a break in production.

Gas entering the filling machine causes many problems.

One problem is that gas bubbles may rise inside the product lines or channels. These bubbles can reach the charge-providing vessel in a filling machine. Germs carried by gas in the bubbles may contaminate the charge. Since the charge-providing vessel is common to all filling elements, this would impact not only the particular filling element but all filling elements.

Another problem is that gas bubbles impair the measurement accuracy of flow-measuring equipment. This, in turn, impairs the ability to control the filling volume of the containers. As a result, containers may have too much or too little charge in them.

One way to avoid difficulties caused by gas in the filling system is to pass a relatively large quantity of charge through the filling elements of a filling machine in a pre-running mode prior to the actual start of production, and then to discard this charge. This is wasteful. Additionally, no containers are fed to the filling machine during this pre-running mode. This means that copious quantities of charge flow freely onto the floor. This results in a mess with that must be cleaned up.

SUMMARY

A problem addressed by the invention is that of providing a filling element that avoids air and/or vapor and/or gas residues, but also excess gas (inert gas or CO2 gas) that is not bound in the product or is intrinsic to the product but released, within the liquid channel of the filling element and that avoids the associated disadvantages.

In one method according to the invention, the venting of the filling elements of the filling system or filling machine takes place in particular prior to each start of production, namely in such a way that the liquid valves of the filling elements are closed and the gas pathways that serve for venting are opened. At the same time or thereafter, charge is introduced into the filling elements or into the liquid channels (valve chambers) thereof until they are in each case completely filled with the charge and any gas and/or vapor and/or air residues are completely displaced from the liquid channels by the charge. A venting of the filling elements may also take place during ongoing production, for example by manual intervention or else automatically, e.g. at predefined time intervals.

In one aspect, the invention features an apparatus comprising a filling element for filling containers with a liquid charge. Such a filling element includes a filling-element housing having a liquid channel formed therein, a venting system, a valve actuating mechanism, and a liquid valve. At a first location, a product line connects to the liquid channel. At a second location above the first location, and also above the liquid valve, the venting system connects to the liquid channel. The liquid valve is upstream of a dispensing opening and is configured to be actuated by the actuating mechanism for controlled dispensing of the liquid charge through the dispensing opening and into a container.

In some embodiments, the venting system comprises a venting channel that opens into the liquid channel. The venting channel is connected to a collecting space. Among these are embodiments in which the venting channel is in communication with a channel that opens into the liquid channel in a region upstream of a valve seat of a valve body of the liquid valve relative to a flow direction of the liquid charge.

In some embodiments the venting channel that opens into the liquid channel is configured as a gas trap, or as a collecting space that is formed by at least one portion of the liquid channel.

In other embodiments, the venting system is disposed on a region of the liquid channel that is provided above an opening of a product channel for feeding the liquid charge into the liquid channel.

Yet other embodiments include those in which the venting system is disposed on a region of the liquid channel that is provided on a region of the liquid channel that is at a highest level of the liquid channel.

Also among the embodiments are those in which the venting system is connected to a channel that is part of a channel or line system of the filling element used for CIP cleaning and/or disinfection, and those in which the venting system is connected to a channel that is part of a heating circuit.

Among the embodiments are those in which the filling element is configured for free-flow filling, and those in which it is configured for pressure filling.

Yet other embodiments include a rotor that can be driven to rotate about a vertical machine axis. In these embodiments, the filling element, together with additional filling elements, is provided on the rotor.

Embodiments also include those in which, during filling of a container, the liquid charge flows along a flow path that extends through the product line, through the liquid channel, and through the dispensing opening. In these embodiments, the liquid valve is on the flow path.

Also included are embodiments in which the filling element is configured for filling a container that has a container opening thereof located at a non-zero distance from the dispensing opening during filling such that air displaced from the container during filling flows freely into the atmosphere.

In another aspect, the invention features a method for venting filling elements of a filling apparatus having a plurality of filling elements for filling containers with a liquid charge that is stored in a vessel common to all of the filling elements, each of the filling elements comprising a liquid channel to which is connected, at a first location, a product line, and, to which is connected, at a second location that is above the first location, a venting system, and, under the second location, a liquid valve controlled by a valve actuator for enabling charge to flow along a flow path. Such a method includes closing the liquid valves of the filling elements, introducing the charge from the vessel into the liquid channels of the filling elements with the liquid valves closed, and venting the liquid channels via the venting system. Venting comprises displacing gas present in the liquid channel using charge flowing into the liquid channel.

Some practices include, after venting the liquid channel, closing the venting system using a valve.

Other practices include those in which venting the liquid channel includes venting at a region of the liquid channel that is located above a region at which the charge is fed into the liquid channel.

Yet other practices further include ending the venting of the liquid channel when the liquid channel is completely filled with the charge.

Among other practices are those in which the flow path extends through the product line, through the liquid channel, through a dispensing opening downstream from the liquid valve, and into a container.

In another aspect, the invention features an apparatus comprising a filling element for filling containers with a charge. Such a filling element include a filling-element housing having formed therein means for guiding charge, as well as means for venting gas from the means for guiding charge, a valve actuating mechanism, and a liquid valve. A means for introducing charge connects to the means for guiding charge at a first location. Meanwhile, the means for venting gas from the means for guiding charge connects to the means for guiding charge at a second location that is above the first location and above the liquid valve. The liquid valve, which is configured to be actuated by the actuating mechanism for controlled dispensing of the charge through the dispensing opening and into a container, is upstream of a dispensing opening.

As used herein, "container" includes packaging means that are usually used for liquid and/or paste-like products, in particular for beverages, for example including soft packaging made from flat material, containers made from metal, glass and/or plastic, for example cans, bottles, etc.

As used herein, "substantially" means deviations of ±10%, preferably of ±5%, from an exact value and/or deviations in the form of changes that have no effect on the function.

As used herein, "free-flow filling" means a filling method in which the charge flows into the container to be filled in a free charge stream. In free-flow filling, the container does not bear with its container mouth or opening against the filling element. Instead, it is spaced apart from the filling element or from a dispensing opening thereon. An important feature of free-flow filling is that the air displaced from the container by the charge during the filling process does not enter the filling element or a gas-conducting region or channel formed therein. Instead, it flows freely into the environment.

In the context of the invention, "pressure filling" means a method in which the charge is fed to a container to be filled that is arranged against the filling element to form a seal and that is usually pressurized with a pressurizing gas, such as inert gas or CO2 gas, and in which inert gas displaced from the interior of the container by the inflowing charge during the filling process is conveyed away via a gas channel formed in the filling element.

As used herein, a "cleaning medium" refers to a cleaning and/or disinfecting medium such as one that would be used for CIP cleaning and/or disinfection.

As used herein, "gaseous contaminants" include gases or vapors, including mixtures of gases and/or vapors, that are not intended to be in the filling element. These include gases and/or vapors that are left over from cleaning media used during CIP cleaning and/or disinfection.

Further developments, advantages and possible uses of the invention will become apparent from the following description of examples of embodiments and from the figures. All the features described and/or shown in the figures, per se or in any combination, form, in principle, the subject matter of the invention, regardless of the way in which they are combined or refer back to one another in the claims. The content of the claims also forms part of the description.

BRIEF DESCRIPTION OF THE FIGURES

These and other features of the invention will be apparent from the following detailed description and the accompanying figures, in which.

DETAILED DESCRIPTION

Figure 1:
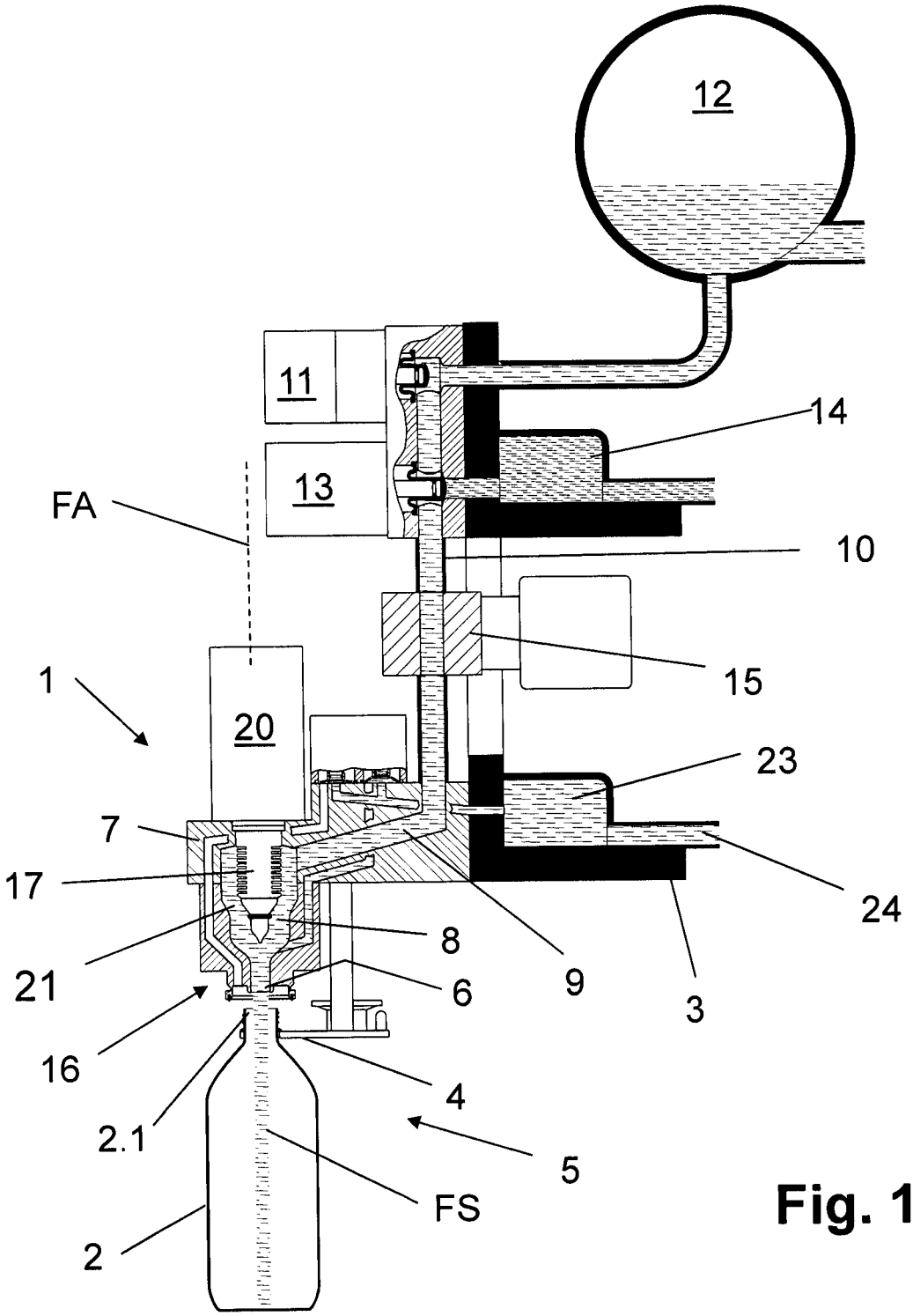
FIG. 1 shows, in a simplified view and in cross-section, a filling element of a filling system or filling machine for the free-flow filling of containers with a charge.

FIG. 1 shows a filling element 1 for free-jet filling of bottles 2 with a charge. The charge has two constituents. A first constituent is mostly liquid. A second constituent is mostly solid. An example of a liquid constituent is fruit juice. An example of a solid constituent is fruit fiber, fruit flesh, pulp, and/or fruit pieces suspended in a liquid suspension medium.

The filling element 1, together with a container carrier 4, form a filling position 5 that is one of many similar filling positions 5 on the periphery of a rotatable rotor 3.

During filling, the container carrier 4 suspends a bottle 2 by its opening flange and with its bottle opening 2.1 arranged below and separated from a dispensing opening 6 of the filling element 1. The container carrier 4 suspends the bottle 2 so that the bottle 2 is coaxial or substantially coaxial with a vertical filling-element axis FA. As a result, during filling, charge flows into the bottle 2 as a free charge jet FS, best seen in FIG. 2.

At an upper region thereof, the product channel 10 connects to both a boiler 12 and a ring channel 14. During the filling operation, the boiler 12 and the ring channel 14 contain the first and second charge constituents respectively. A first metering valve 11, which is between the product channel 10 and the boiler 12, meters the quantity of the first constituent. A second metering valve 13, which is between the ring channel 14 and the product channel 10, meters the quantity of the second constituent. All the filling elements 1 on the rotor 3 are connected to the same boiler 12 and ring channel 14.

A flow meter 15 arranged in the product channel 10 supplies a signal corresponding to the charge flow through the product channel 10. This signal is provided to a central control unit, such as a computer-supported machine controller.

The signals from the first and second metering valves 11, 13 provide a basis for adjusting a mixing ratio of the two components based on a recipe. This is achieved by actuating the first and second metering valves 11, 13. The flow meter 15 provides a signal that is used to determine that enough charge has entered the bottle 2 so that the liquid valve 16 can be closed.

Figure 2:
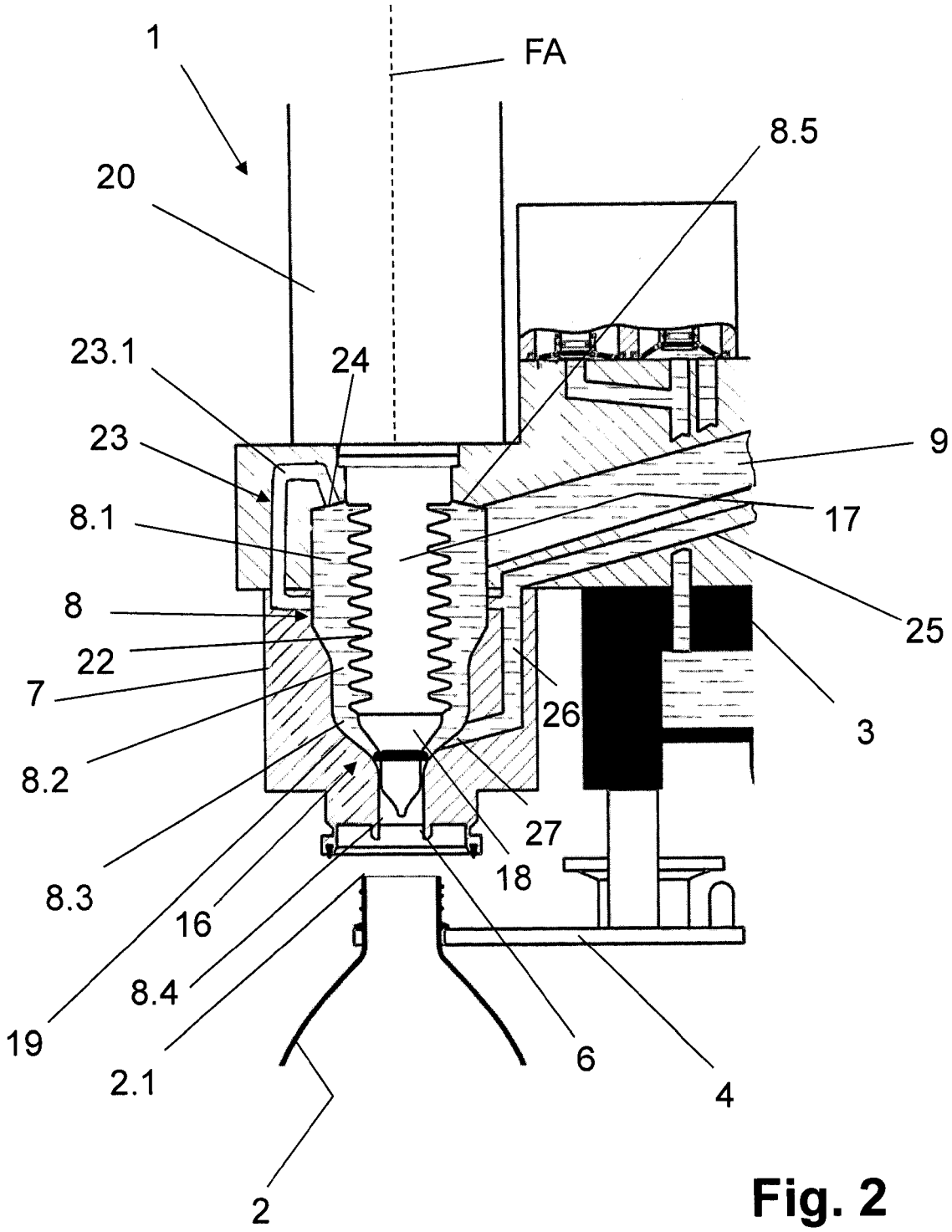
FIG. 2 shows the filling element of FIG. 1 with the liquid valve closed, rather than opened.

The liquid valve 16 includes a plunger 17 that is arranged to be coaxial with the filling element axis FA. Referring to FIG. 2, a lower end of the plunger 17 forms a valve body 18 that concentrically surrounds the filling element axis FA. The valve body 18 has a valve-body seal that cooperates with a valve surface formed on a conical face 19 of the liquid channel 8 to make a seal. The conical face 19 is rotationally symmetrical about the filling element axis FA.

An actuator 20 opens and closes the liquid valve 16 by moving the valve plunger 17 and its valve body 18 along the filling element axis FA between a closed position, shown in FIG. 1, and an open position, shown in FIG. 2.

In the closed position, the valve surface of the valve body 18 bears against the valve surface formed by the conical face 19. In the open position, the valve surface of the valve body 18 is at a non-zero distance from the conical face 19. This forms an annular opening gap 21 of considerable gap width between the valve body 18 and the inner face of the liquid channel 8. In some embodiments, the gap width is more than 4 mm. In other embodiments, the gap width is between 8 mm and 20 mm. In yet other embodiments, the gap width is between 13 mm and 16 mm. As a result of this wide gap, it is possible to fill bottles 2 with a mixed product consisting of the first component from the vessel 12 and the second component from the annular channel 14 without the solid constituents clogging the filling element.

A bellows 22 surrounds the valve plunger 17 and acts as a seal that seals off the passage of the valve plunger 17 through the filling element housing 7. The bellows 22 have an external diameter that is equal to, or substantially equal to, a maximum external diameter of the valve body 18.

In the embodiment shown, the liquid channel 8 is made of a first liquid-channel-portion 8.1, a second liquid-channel-portion 8.2, a third liquid-channel-portion 8.3, a fourth liquid-channel-portion 8.4, and a fifth liquid-channel-portion 8.5.

The fourth liquid-channel-portion 8.4 ends at the dispensing opening 6. The third liquid-channel-portion 8.3 adjoins the fourth liquid-channel-portion 8.4. The first liquid-channel-portion is between the fifth liquid-channel-portion 8.5 and the second liquid-channel portion 8.2. The second liquid-channel-portion 8.2 is between the first liquid-channel-portion 8.1 and the third liquid-channel-portion 8.3. The first liquid-channel-portion 8.1, the second liquid-channel-portion 8.2, the third liquid-channel-portion 8.3, the fourth liquid-channel-portion 8.4, and the fifth liquid-channel-portion 8.5 are all coaxial with the filling-element axis FA.

The first liquid-channel-portion 8.1 is defined in part by a cylindrical or substantially cylindrical wall having a first diameter. The product-channel portion 9 empties into this first liquid-channel-portion 8.1.

The second liquid-channel-portion 8.2 is defined in part by a cylindrical or substantially cylindrical wall having a second diameter. The second diameter is smaller than the first diameter. The cross-sectional area of the second liquid-channel-portion 8.2 is smaller than the cross-sectional area of the first liquid-channel-portion 8.1.

The third liquid-channel-portion 8.3 is defined in part by the conical face 19 and thus tapers like a hopper towards the underside of filling element 1. The diameter of the third liquid-channel-portion 8.3 is greatest where it adjoins the second liquid-channel-portion 8.2 and is smallest where it adjoins the fourth liquid-channel-portion 8.4.

The fourth liquid-channel-portion 8.4 has a circular cylindrical cross section that ends at the dispensing opening 6.

The fifth liquid-channel-portion 8.5 is a dome-shaped portion at the very top. It is described below in connection with the venting system.

All of liquid-channel portions 8.1-8.5 are coaxial with the axis FA. In the closed state of the filling element 16, the third liquid-channel-portion 8.3 and the fourth liquid-channel-portion 8.3 accommodate the valve body 18. In the fully open state of the liquid valve 16, the second liquid-channel-portion 8.2 accommodates the valve body 18 and the opening gap 21 reaches its full width.

To avoid the various disadvantages of gas entering the filling element as described above, the liquid channel 8 is designed with a venting system.

This venting system comprises a first venting-channel 23 that is formed in the filling-element housing 7. The first venting-channel 23 opens into the liquid channel 8 via a first opening 24 on an upper side remote from the dispensing opening 6. The first opening 24 is at the very top of the liquid channel 8 and above the liquid valve 16.

A second venting-channel 25 is in communication with the first venting-channel 23. The second venting-channel 25, in turn, connects to a collecting channel or annular channel (not shown in detail) provided on the rotor 3. The collecting channel is common to all the filling elements 1 of the filling machine. In some cases, the collecting channel can be a vacuum channel.

The first venting-channel 23 preferably has a gas-trap portion 23.1 next to the first opening 24. Starting from the opening, the gas-trap portion 23.1 runs upward and then downward again before opening into the second venting-channel 25. As a result of the path it follows, gaseous contaminants present in the liquid channel 8 tend to collect in the gas-trap portion 23.1 and to be conveyed away via the first venting-channel 23.

In order to enhance this effect, the liquid channel 8 has a convex upper-boundary wall on an inner side thereof. This forms the dome-like fifth liquid-channel-portion 8.5 above the first liquid-channel-portion 8.1 and above the opening at which the product line portion 9 opens into the liquid channel 8. Gaseous contaminants tend to collect in this domed fifth liquid-channel-portion 8.5. The first opening 24 into the first venting channel 23 is at the top of this fifth liquid-channel portion 8.5.

The filling-element housing 7 also forms a third venting-channel 26. The third venting-channel 26 opens via a second opening 27 into the third liquid-channel-portion 8.3 above the valve seat that is formed on the conical face 19 and against which the valve body 18 or the seal thereof bears when the liquid valve 16 is closed. The third venting-channel 26 likewise opens into the second venting-channel 25.

In some embodiments, each filling element 1 also includes a separate venting valve that controls the venting of that filling element 1. The venting valve can be placed in the second venting-channel 25. In other embodiments, a group of filling elements 1 shares the same venting valve. In yet other embodiments, all the filling elements 1 of the filling machine share the same venting valve.

Some embodiments have a charge-heating circuit in which is incorporated the first venting-channel 23, the second venting-channel 25, and the third venting-channel 26. Other embodiments include a CIP cleaning circuit that incorporates the second and third venting channels 25, 26.

The venting of the respective filling element 1 via the first venting channel 23 takes place prior to each start of production. The procedure begins with closing the liquid valve 16, opening the first venting channel 23, and opening the second venting-channel 25. The procedure continues with introducing the first and second charge constituents from the vessels 12 and the annular channel 14 respectively and conducting then into the liquid channel 8 via the product line 10. Any gaseous contaminants in the liquid channel 8 are then conveyed into the venting system through the first venting-channel 23, which conveys them away. Eventually, the filling element 1 is completely filled with the charge.

Filling elements 1 can also be vented during ongoing production, for example by manual intervention or else automatically, e.g. at predefined time intervals, preferably with the liquid valve 16 closed in each case.

Figure 3:
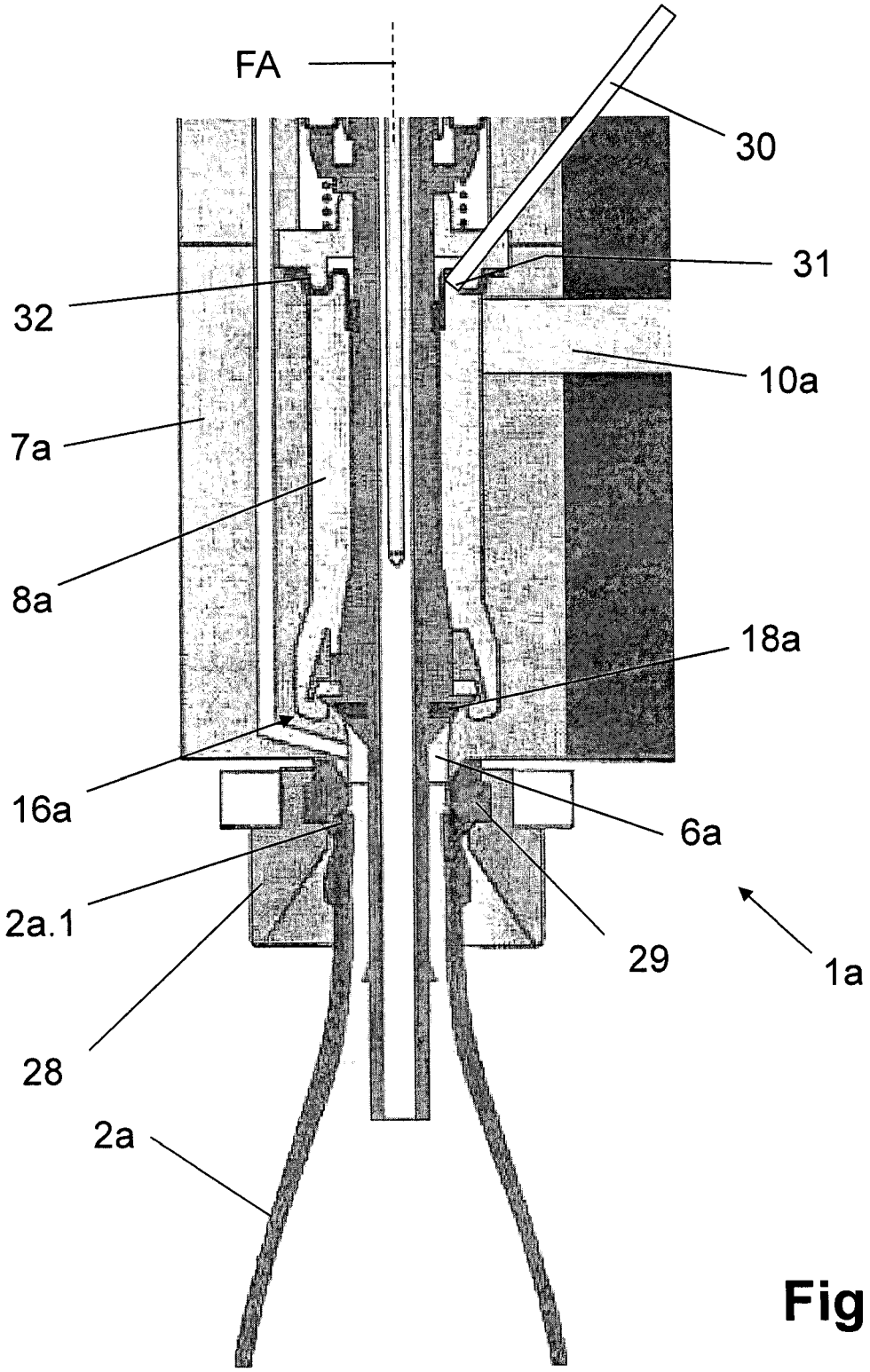
FIG. 3 shows, in an enlarged partial view, the liquid valve of a filling system or filling machine for the pressure filling of containers with a charge, with the liquid valve closed.

FIG. 3 shows a simplified partial view of a filling element 1*a* for pressure filling of bottles 2*a* with a charge. The filling element 1*a* includes a filling-element housing 7*a* that forms a liquid channel 8*a*, or valve chamber. In its upper region, the liquid channel 8 connects to a product line 10*a* that feeds the charge, which is at a filling pressure. In its lower region, the liquid channel 8*a* forms a dispensing opening 6*a* on the underside of the filling element housing 7*a*.

During filling, a mouth 2*a*.1 of a bottle 2*a* presses against the dispensing opening 6*a* to form a seal 29 at a centering bell 28. A liquid valve 16*a* in the liquid channel 8*a* comprises the valve body 18*a* that cooperates with a valve seat on the inner face of the liquid channel 8*a*. The valve body 18*a* moves up and down by a predefined stroke along the filling element axis FA by means of an actuating mechanism. This movement opens and closes the liquid valve 16*a*.

The filling element 1 and the liquid channel 8*a* have a venting system for conveying away gaseous contaminants. In this embodiment, the venting system comprises a fourth venting-channel 30 that opens into the liquid channel 8*a* via a third opening 31. The third opening 31 is at the highest region of the liquid channel 8*a* and above the opening through which the product channel 10*a* delivers charge into the liquid channel 8*a*.

In the illustrated embodiment, the third opening 31 is located in the region of a seal 32 that seals off the liquid channel 8*a* at an upper end thereof. The fourth venting-channel 30 connects to a collecting channel or annular channel, for example to a vacuum channel that is provided on the rotor 3*a* jointly for all the filling elements of the filling machine. The venting system is controlled using at least one venting valve that is provided separately for each filling element 1*a* or else jointly for all the filling elements or for a group of multiple filling elements. The third venting-channel 30 can also be incorporated into a circuit for a cleaning medium.

The invention presented above is configured in a particularly advantageous manner because bubbles of gaseous contaminants, wherever situated, can rise through the various components of the filling element without disruption until they reach the vessel 12.

To promote the bubbling action, and in particular to prevent such gas bubbles from adhering to walls, undercuts, or connection points of the components, and all flow pathways have sufficient incline relative to the horizontal. In addition, geometric dimensions or properties of the components are selected to avoid undercuts, rough surfaces and protrusions.

The invention has been described above on the basis of examples of embodiments. It will be understood that numerous changes and modifications are possible without thereby departing from the inventive concept on which the invention is based.

The invention claimed is:

1. An apparatus comprising a filling element for filling containers with a liquid charge, said filling element comprising a filling element housing having a liquid channel formed therein, a product line, a dispensing opening, a venting system, a valve actuating mechanism, and a liquid valve, wherein said product line connects to said liquid channel at a first location, wherein said venting system connects to said liquid channel at a second location, wherein said second location is above said first location, wherein said second location is above said liquid valve, wherein said liquid valve is upstream, relative to a flow direction of said liquid charge, of said dispensing opening, and wherein said liquid valve is configured to be actuated by said actuating mechanism for controlled dispensing of said liquid charge through said dispensing opening and into a container.

2. The apparatus of claim 1, wherein said venting system comprises a venting channel that opens into said liquid channel, said venting channel being connected to a collecting space.

3. The apparatus of claim 2, wherein said venting channel is in communication with a channel that opens into said liquid channel in a region upstream, relative to a flow direction of said liquid charge, of a valve seat of a valve body of said liquid valve relative to a flow direction of said liquid charge.

4. The apparatus of claim 1, wherein said venting system is disposed on a region of said liquid channel that is provided above, relative to a vertical axis, an opening of a product channel for feeding said liquid charge into said liquid channel.

5. The apparatus of claim 1, wherein said venting system is disposed on a region of said liquid channel that is provided on a region of the liquid channel that is at the highest level relative to a vertical axis.

6. The apparatus of claim 1, wherein said venting system is connected to a channel that is part of a channel or line system of said filling element used for CIP cleaning and/or disinfection.

7. The apparatus of claim 1, wherein said filling element is configured for free-flow filling.

8. The apparatus of claim 1, wherein said filling element is configured for pressure filling.

9. The apparatus of claim 1, further comprising a rotor that can be driven to rotate about a vertical machine axis, wherein said filling element, together with additional filling elements, is provided on said rotor.

10. The apparatus of claim 1, wherein, during filling of a container, said liquid charge flows along a flow path that extends through said product line, through said liquid channel, and through said dispensing opening, and wherein said liquid valve is on said flow path.

11. The apparatus of claim 1, wherein said venting system is connected to a channel that is part of a heating circuit.

12. The apparatus of claim 1, wherein said filling element is configured for filling a container that has a container opening thereof located at a non-zero distance from said dispensing opening during filling such that air displaced from said container during filling flows freely into the atmosphere.

13. The apparatus of claim 1, wherein said venting system comprises a venting channel that opens into said liquid channel, said venting channel being configured as a gas trap.

14. The apparatus of claim 1, wherein said venting system comprises a venting channel that opens into said liquid channel, said venting channel being configured as a collecting space that is formed by at least one portion of the liquid channel.

15. A method for venting filling elements of a filling apparatus having a plurality of filling elements for filling containers with a liquid charge that is stored in a vessel common to all of said filling elements, each of said filling elements comprising a liquid channel to which is connected, at a first location, a product line, and, to which is connected, at a second location that is above said first location, a venting system, and a liquid valve below said second location, said liquid valve enabling liquid charge to flow along a flow path under control of an actuator, said method comprising closing said liquid valves of said filling elements, introducing said liquid charge from said vessel into said liquid channels of said filling elements with said liquid valves closed, and venting said liquid channels via said venting system, wherein venting comprises displacing gas present in said liquid channel using liquid charge flowing into said liquid channel.

16. The method of claim 15, further comprising, after venting said liquid channel, closing said venting system using a valve.

17. The method of claim 15, wherein venting said liquid channel comprises venting at a region of said liquid channel that, relative to a vertical axis, is located above a region at which said liquid charge is fed into said liquid channel.

18. The method of claim 15, further comprising ending said venting of said liquid channel when said liquid channel is completely filled with said liquid charge.

19. The method of claim 15, wherein said flow path extends through said product line, through said liquid channel, through a dispensing opening downstream from said liquid valve, and into a container.

20. An apparatus comprising a filling element for filling containers with a charge, said filling element comprising a filling-element housing having formed therein means for guiding charge, and means for venting gas from said means for guiding charge, a valve-actuating mechanism, a liquid valve, means for introducing charge, said means for introducing charge being connected to said means for guiding charge, said means for introducing charge being disposed at a first location, means for venting gas from said means for guiding charge, said means for venting gas being connected to said means for guiding charge at a second location that is above said first location and above said liquid valve, wherein said liquid valve, which is configured to be actuated by said actuating mechanism for controlled dispensing of said charge through said dispensing opening and into a container, is upstream of a dispensing opening.

* * * * *